US006278370B1

(12) United States Patent
Underwood

(10) Patent No.: US 6,278,370 B1
(45) Date of Patent: Aug. 21, 2001

(54) CHILD LOCATING AND TRACKING APPARATUS

(76) Inventor: Lowell Underwood, 120-23A Benchley Pl., Bronx, NY (US) 10475

( * ) Notice: Subject to any disclaimer, the term of this patent is extended or adjusted under 35 U.S.C. 154(b) by 0 days.

(21) Appl. No.: 09/433,668

(22) Filed: Nov. 4, 1999

(51) Int. Cl.[7] ..... G08B 23/00

(52) U.S. Cl. ..... 340/573.1; 340/539; 340/574; 342/457

(58) Field of Search ..... 340/573.1, 573, 340/539, 574; 342/457

(56) References Cited

U.S. PATENT DOCUMENTS

| | | | | |
|---|---|---|---|---|
| 4,591,836 | * | 5/1986 | Feigenblatt, Jr. et al. | 340/574 |
| 5,021,794 | * | 6/1991 | Lawrence | 342/457 |
| 5,521,582 | * | 5/1996 | Kingston | 340/539 |
| 5,712,619 | * | 1/1998 | Simkin | 340/539 |
| 5,742,233 | * | 4/1998 | Hoffman et al. | 340/573 |
| 6,014,080 | * | 10/1998 | Layson, Jr. | 340/573.1 |

* cited by examiner

*Primary Examiner*—Daniel J. Wu
*Assistant Examiner*—Phung Nguyen
(74) *Attorney, Agent, or Firm*—John D. Gugliotta

(57) ABSTRACT

A child locating and tracking apparatus which provides for the location of a child that is lost, abducted or in general danger to be quickly located is disclosed. The apparatus uses a small transmitter that is always carried by the child and as such, is always present when danger arises. The transmitter is easily disguised and hidden in the child's clothing or personal adornments such as shoes, coats, watches, earrings, bracelets, rings and the like. The apparatus uses a system of world wide receivers such as those provided by local cellular telephone towers or by low earth orbiting satellites used for low power communication. When a child is lost or in danger, the child simply activates the transmitter which sends a signal to a central reporting station or stations where trained personnel will contact the respective parents and/or care givers to determine if the child could possibly be in danger. If an affirmative decision is reached, the monitoring station personnel will then assist the local law enforcement officials in the respective area anywhere in the world where the alarm was received in locating the child and removing the child from harm's path.

2 Claims, 5 Drawing Sheets

CHILD LOCATING AND TRACKING APPARATUS

BACKGROUND OF THE INVENTION

1. Field of the Invention

The present invention relates generally to locating and tracking apparatuses and more particularly, to a locating and tracking apparatus for lost or abducted children.

2. Description of the Related Art

The safety and well being of children takes the utmost priority in the lives of most people and most particularly in the lives of the parents and/or care givers. To that objective, people have been turning to technology more and more to protect children. Such technological means have included both audio and video monitors, alarm systems and the like. One danger to children that is one of the most frightful to parents and/or care givers is the threat of abduction or of the child becoming lost. While such technology exists for protection of automobiles against similar threats such as car jacking and theft, this technology has not been used to protect children against similar threats.

The previous art consists of many examples of devices that will alert parents and/or care givers to possible dangers to children against unintentional separation of the child from the parent and/or care giver greater than a predetermined distance. Examples of such prior art include the following:

| U.S. Pat. No. | Inventor | Issue Date |
|---|---|---|
| 5,650,770 | Schlager et al. | Jul. 22, 1997 |
| 5,557,259 | Musa | Sep. 17, 1996 |
| 5,389,915 | Chen | Feb. 14, 1995 |
| 4,899,135 | Ghahariiran | Feb. 6, 1990 |
| 4,785,291 | Hawthorne | Nov. 15, 1988 |
| 4,675,656 | Narcisse | Jun. 23, 1987 |
| 4,593,273 | Narcisse | Jun. 3, 1986 |

While these devices serve a purpose in the retention of young children in crowded areas or in retaining the child in a specific area such as a yard or playground, they do not protect the child that may be older and thus allowed a greater distance from home. Many children become lost and/or abducted while returning from school, playing at a friend's house or while engaged in extended outdoor activities such as hiking or camping. The above-mentioned devices do not allow for protection of the child in such circumstances and are thus unsuitable for the application. Also, these devices work with a dedicated matched receiver that has a limited range, and as such is not suitable for locating a child that has traveled a great distance, such as when abducted by car, away from the original location. Some abductions of children involve the moving of the children into other countries using airplanes, where clearly only a worldwide monitoring system would suffice.

Other prior art includes security devices in which a lost or abducted child can be located by using a radio receiver that monitors the signal transmitted by a matching transmitter in possession of the lost or abducted child. Examples of such prior art include the following:

| U.S. Pat. No | Inventor | Issue Date |
|---|---|---|
| 5,714,932 | Castellon et al. | Feb. 3, 1998 |
| 5,617,074 | White | Apr. 1, 1997 |
| 5,121,096 | Moore et al. | Jun. 9, 1992 |
| 5,115,223 | Moody | May. 19, 1992 |
| 5,025,247 | Banks | Jun. 18, 1991 |
| 4,777,478 | Hirsch et al. | Oct. 11, 1988 |
| 4,736,196 | McMahon et al. | Apr. 5, 1988 |

While these devices allow for the alerting of parents and/or care givers, they require the use of a large and/or cumbersome transmitter. While such a transmitter may be acceptable to adults, children are less likely to carry such a device on a regular basis. Additionally, these devices suffer from the same problem as listed above, that is the problem of requiring a matched receiver with only a limited receiving distance.

Consequently, a need has been felt for providing a device and method which overcomes the problems cited above.

SUMMARY OF THE INVENTION

It is therefore an object of the present invention to provide an improved child locating and tracking apparatus.

It is therefore another object of the present invention to provide an improved child locating and tracking apparatus that allows for the location of a child in danger anywhere in the world without the use of specific matched receivers.

It is therefore yet another object of the present invention to provide an improved child locating and tracking apparatus which utilizes a transmitter of small size such that it always may be continually carried by the child whether at home, school, at play or travel.

It is therefore another object of the present invention to provide an improved child locating and tracking apparatus that utilizes a transmitter that may easily be concealed in such articles of clothing or adornments such as shoes, coats, watches, earrings, bracelets, rings and the like.

It is therefore yet another object of the present invention to provide an improved child locating and tracking apparatus that allows for the determination of distance and bearing to a lost or abducted child in a quick and timely manner.

Briefly described according to the preferred embodiment of the present invention, an improved child locating and tracking apparatus which provides for the location of a child that is lost, abducted or in general danger to be quickly located is disclosed. The apparatus uses a small transmitter that is always carried by the child and as such, is always present when danger arises. The transmitter is easily disguised and hidden in the child's clothing or personal adornments such as shoes, coats, watches, earrings, bracelets, rings and the like. The apparatus uses a system of world wide receivers such as those provided by local cellular telephone towers or by low earth orbiting satellites used for low power communication. When a child is lost or in danger, the child simply activates the transmitter which sends a signal to a central reporting station or stations where trained personnel will contact the respective parents and/or care givers to determine if the child could possibly be in danger. If an affirmative decision is reached, the monitoring station personnel will then assist the local law enforcement officials in the respective area anywhere in the world where the alarm was received in locating the child and removing the child from harm's path.

It is a feature of the present invention to provide a device that can be easily produced using existing technology, materials and assembly techniques.

Another advantage of the present invention is that it is simple, and therefore, inexpensive to manufacture. This savings, if passed on to the consumer, may influence the public to utilize such a device. A simple design also increases product reliability and useful product lifetime.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

In order to describe the complete relationship of the invention, it is essential that some description be given to the manner and practice of functional utility and description of a child locating and tracking apparatus.

The best mode for carrying out the invention is presented in terms of its preferred embodiment, herein depicted within the Figures.

1. Detailed Description of the Figures

Figure 1:
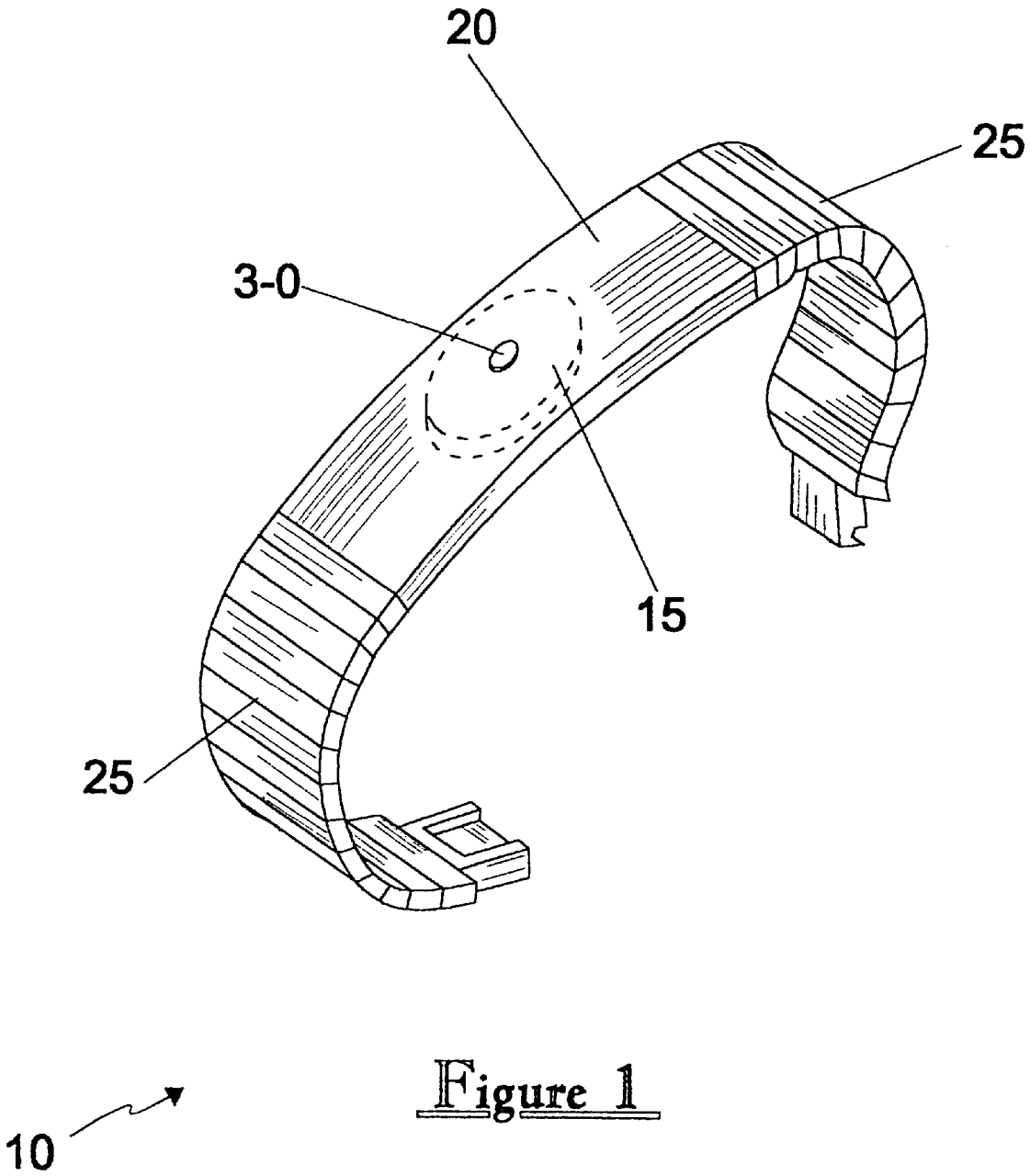
FIG. 1 is a perspective view of a child locating and tracking apparatus shown in a utilized state hidden in a bracelet according to a preferred embodiment of the present invention.

Referring now to FIG. 1, a perspective view of a child locating and tracking apparatus 10 is disclosed. A transmitting module 15 is shown via hidden lines as disguised within an adornment 20. The adornment 20 in this case is shown as a bracelet, but should not be interpreted as a limiting factor. It is envisioned that the adornment 20 may also take the shape of articles of clothing, shoes, coats, watches, earrings, bracelets, rings and the like. The adornment 20 is attached to the child by means of a retaining means 25, such as a chain or in other instances such as a zipper, fabric, buttons, snaps, clasps, laces or the like. It is important that the retaining means 25 hold the adornment 20 with the associated transmitting module 15 in close contact with the child's body to prevent inadvertent operation as will be seen in greater detail hereinbelow. The transmitting module 15 has an activating switch 30, which may penetrate the adornment 20 as shown in this FIG. or may be concealed and actuated from within fabric such as with clothing, jackets, shoes or the like. The activating switch 30 is pressed by the child when the child is in danger. Such danger is envisioned to be when the child is lost or abducted, though it should be envisioned that other dangers such as fire, physical harassment, animal attacks, extreme fear and the like may also prove grounds to press the activating switch 30 and activate the transmitting feature of the transmitting module 15.

Figure 2:
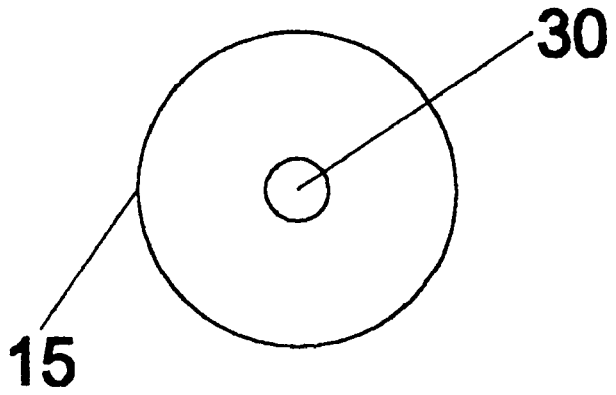
FIG. 2 is a front view of the child locating and tracking apparatus.

Referring next to FIG. 2, a front view of the transmitting module 15 is shown. The transmitting module 15 is shown round in nature, though not intended to be a limiting factor. The shape of the transmitting module 15 is primarily dictated by the physical shape of the adornment 20 (as shown in FIG. 1). The overall size of the transmitting module 15 is envisioned to be on the order of one quarter inch, though as electronic technology continues to advance and miniaturize, the size may decrease. The activating switch 30 is centrally located as shown. The overall enclosure of the transmitting module 15 is envisioned to be of injection molded plastic with appropriate seals to allow its use under wet or submerged conditions.

Figure 3:
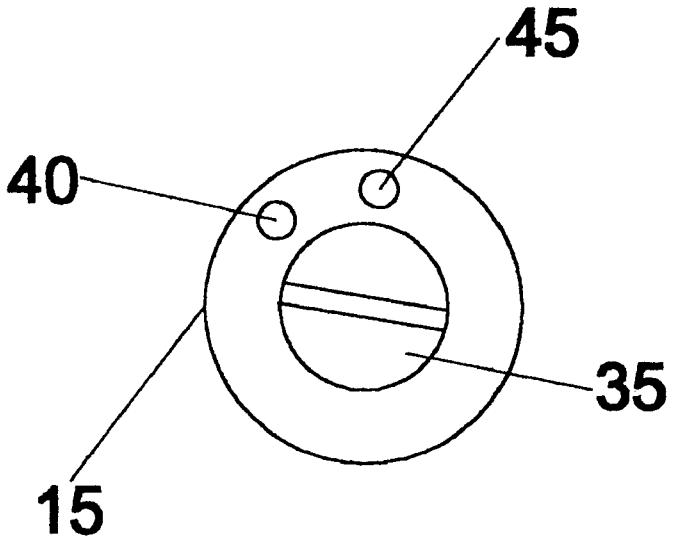
FIG. 3 is a rear view of the child locating and tracking apparatus.

Referring now to FIG. 3, a rear view of the transmitting module 15 is shown. A battery cover 35 is centrally provided to allow for the replacement of an internal battery, whose function will be described in greater detail hereinbelow. Located on the perimeter of the transmitting module 15 is a battery level indication light 40. The battery level indication light 40 will illuminate when less than a day's usable energy remains in the internal battery. The battery level indication light 40 should be observed daily by removing the transmitting module 15 along with the adornment 20 (as shown in FIG. 1). The transmitting module 15 may be removed from the child while the child is sleeping or it may be left on should the threat of danger to the child be interpreted as relatively high. Also located on the perimeter of the transmitting module 15, next to the battery level indication light 40 is a time delay activation module 45. The purpose of the time delay activation module 45 is to allow activation of the transmitting module 15 should the transmitting module 15 be removed from the child. Such removal may occur by the abductor or by accident should the child fall and the transmitting module 15 be removed by the force of falling. An internal time delay circuit, which will be described in greater detail hereinbelow is provided to avert false alarms should the transmitting module 15 be removed on purpose by the child, parent or care giver. Such reasons to remove the transmitting module 15 include but are not limited to battery power level checking, bathing duties, sleeping, and the like. Once removed, a period envisioned to be on the order of five seconds is provided to depress the time delay activation module 45 once again to prevent activation of the transmitting module 15. This feature emphasizes the importance of holding the rear of the transmitting module 15 close to the body of the child as aforementioned described.

Figure 4:
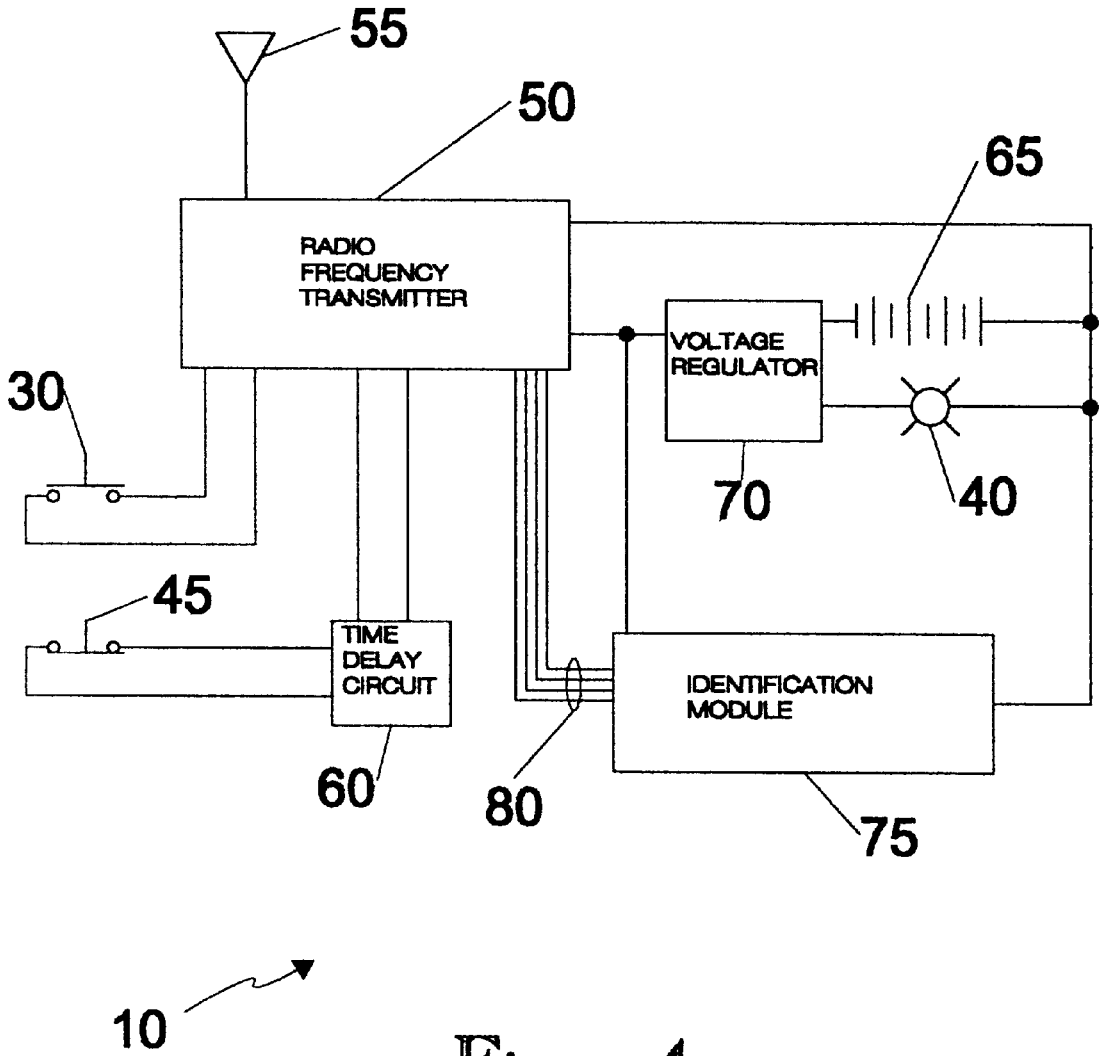
FIG. 4 is a functional electrical block diagram of the associated circuitry as used with the transmitter portion of the child locating and tracking apparatus.

Referring next to FIG. 4, a functional electrical block diagram of the associated circuitry as used with the child locating and tracking apparatus 10 is depicted. A radio frequency transmitter 50 provides an output signal to an antenna 55. The antenna 55 is envisioned to be of a loop type that may be embedded in the perimeter of the transmitting module 15 (as shown in FIG. 2), though it may be seen by those familiar in the art that other types such as microwave, dipole, multiple array and other type antennas will work equally as well and is not intended to be a limiting factor. The activating switch 30 provides an input to the radio frequency transmitter 50 through the form of a normally open push-button switch. The time delay activation module 45 provides an input to a time delay module 60 through the form of a normally closed push-button switch. The time delay module 60 is a simple, commonly known time delay circuit that accepts an input signal, and after a predetermined time delay, passes the input signal onto the radio frequency transmitter 50 as shown. As previously discussed, the time delay interval is envisioned to be on the order of five seconds. A battery 65 provides input power to a voltage regulator module 70 as shown. In the event of low power output from the battery 65, an electrical signal is applied to the battery level indication light 40. The internal parameters of the voltage regulator module 70 are such that there is at least 24 hours of advance warning that the battery 65 is depleted of power before the battery 65 ceases to function. Output power from the voltage regulator module 70 is applied to the radio frequency transmitter 50 and to an identification module 75. The identification module 75 is individually unique for every child locating and tracking apparatus 10 manufactured and posses a unique digital binary signature. This signature is applied to the radio frequency transmitter 50 through a digital signal path 80 as shown. All components as shown in FIG. 4 are envisioned to be of the microminiature nature and perhaps combined by use of Very Large Scale Integration or future electrical assembly method still under development.

Figure 5:
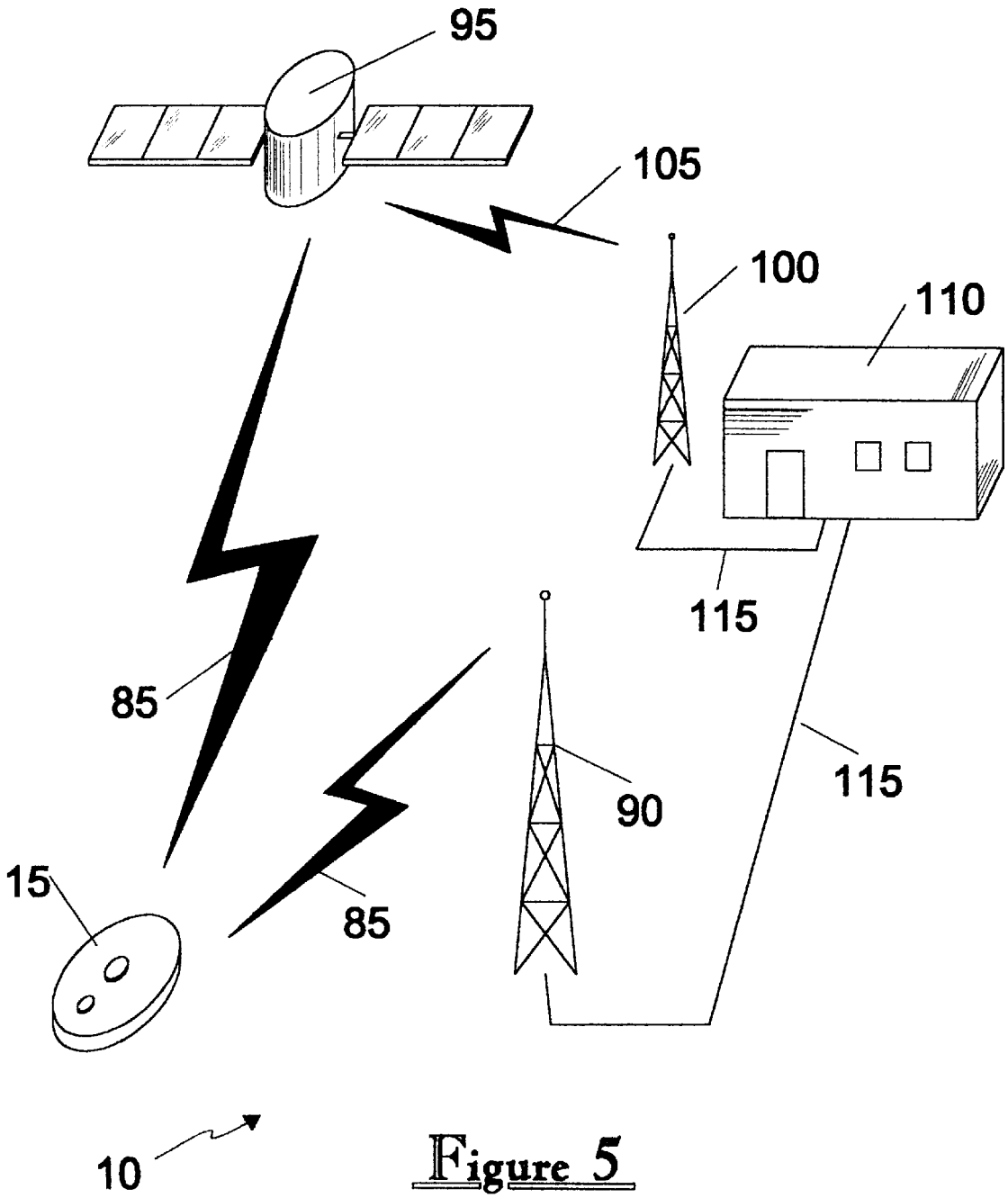
FIG. 5 is a system diagram of the child locating and tracking apparatus showing the radio frequency travel paths as utilized by the present invention.

Referring now to FIG. 5, a system diagram of the child locating and tracking apparatus 10 showing the radio frequency travel paths is disclosed. In the event of activation of the transmitting module 15, a first radio frequency signal 85 is emitted as shown. The first radio frequency signal 85 travels to a local ground station 90. The local ground stations 90 are to be provided country wide on a repeating pattern basis. Those familiar in the art are knowledgeable of the present system of cellular telephone towers presently in place which can be used in the function of the local ground station 90 with little or no modifications. Additionally, other presently available towers as used for television stations, commercial and private radio stations, public service radio systems, paging systems, wireless data systems and the like could also be used in the function of the local ground station 90. However, even with the wide proliferation of land-based radio systems as listed above, there are still areas of the country and especially foreign countries that do not have any coverage by local antenna towers. In such instances a low earth orbit satellites 95, either specifically launched for the purpose, or for other purposes as listed above, would intercept the first radio frequency signal 85 and relay to a distant ground station 100 via a second radio frequency signal 105 as shown. The signals as received at either the local ground station 90 or the distant ground station 100 would then be forwarded to a monitoring station 110 via a land-based communication path 115 such as telephone lines, Internet lines or microwave paths. Once received at the monitoring station 110, computers or personnel will process the received data. The data processing will be described in greater detail hereinbelow. Also, while only one monitoring station 110 is shown in FIG. 5, it is for the purposes of simplicity only and is not intended to be a limiting factor. A world wide system of monitoring station 110 interconnected by independent communication paths would be utilized for purposes of increased reliability via distributed processing and redundant reliability. The usage of local ground stations 90 and/or low earth orbit satellites 95 allows for the pinpointing of a geographic location as defined by the location of the local ground station 90 and/or low earth orbit satellite 95. In this manner, the child in danger who activated the transmitting module 15 may be found in a quick manner. Personnel or equipment in the monitoring station 110 can easily tell the geographic area where the transmitting module 15 was when it was activated. This information can be passed onto local law enforcement personnel who can target that geographic area for the beginning of their search. Then using readily available radio direction finding gear, they may locate the exact location of the transmitting module 15, thus locating the child and begin the process of rendering assistance in a quick timely manner.

Figure 6:
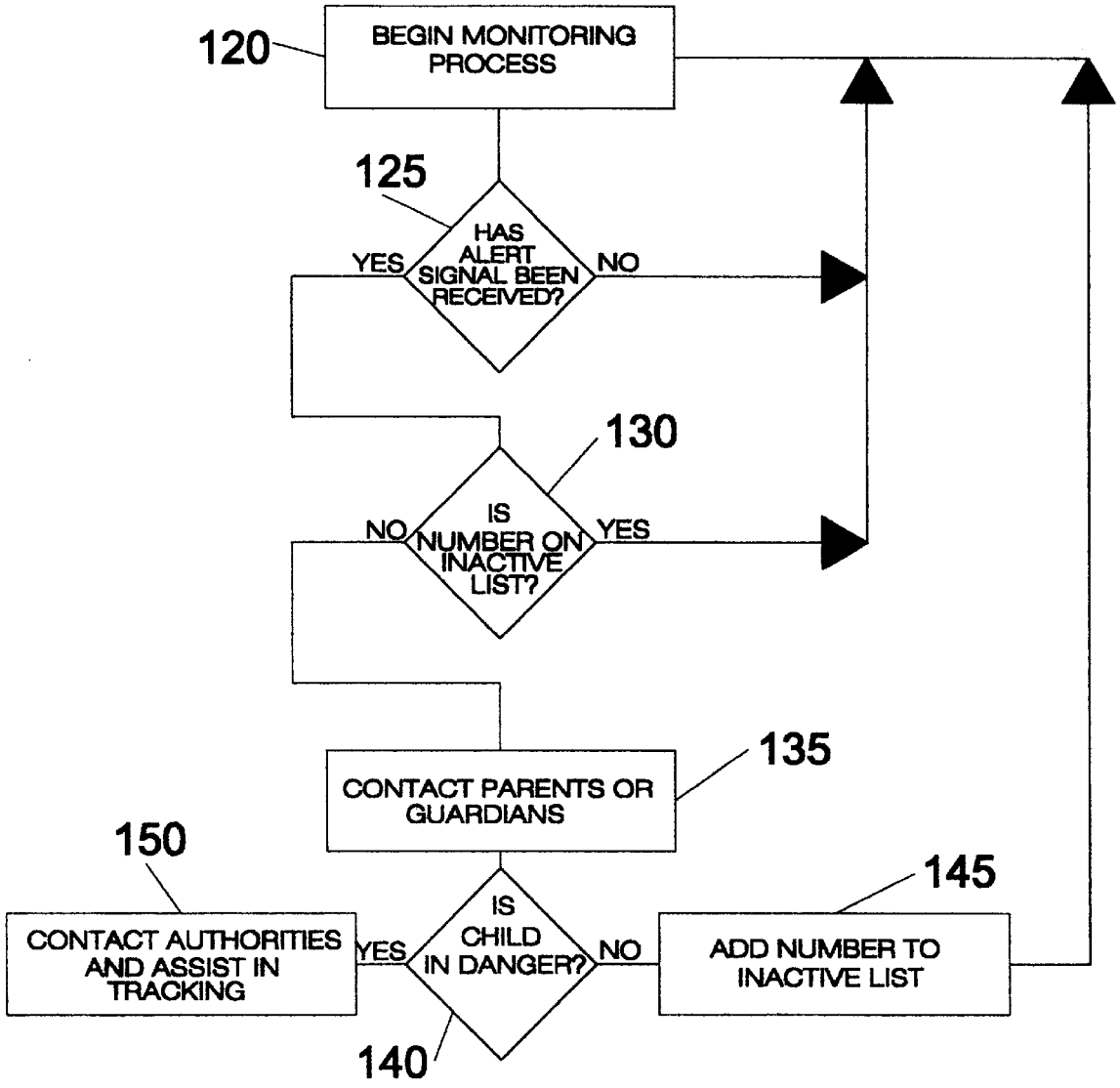
FIG. 6 is a flow diagram depicting the decision tree as used by the monitoring station personnel in determining the safety of a child utilizing the child locating and tracking apparatus.

Referring finally to FIG. 6, a flow diagram depicting the decision tree as used by the monitoring station personnel or monitoring station equipment in determining the safety of a child utilizing the child locating and tracking apparatus 10 is depicted. The process begins at a first operational block 120 which describes the process of waiting for a received first radio frequency signal 85 (as shown in FIG. 3). If no signal is received, a first functional block 125, by way of a negative response, dictates that the process continues. If a positive response results, it must be determined that the signal is from a transmitting module 15 (as shown in FIG. 5) that is not on an inactive list as shown by a second functional block 130. Such transmitting module 15 (as shown in FIG. 5) that would be on an inactive list would be those that are not assigned to a child, those that are lost, or those from a child that is known to be safe. If such a signal is received from those transmitting module 15 (as shown on FIG. 5) that are known to be inactive, a positive response indicates that the monitoring process should begin again at the first operational block 120. If a negative response is received at the second functional block 130, local monitoring personnel or equipment will contact the parents or authorized guardians as dictated by a second operational block 135. If, after conversation or input from the parents or guardians, it is determined that the child is not in danger, a negative response at a third functional block 140 dictates that the number corresponding to the said received signal be added to the inactive list as shown by a third operational block 145. The corresponding number will remain on the inactive list until the parent or authorized guardian calls the monitoring station 110 (as shown in FIG. 5) and reactivates the associated transmitting module 15 (as shown in FIG. 5). If a positive answer or no response is received at the third functional block 140, a fourth operational block 150 dictates that the appropriate law enforcement officials be contacted and assistance in locating the child as aforementioned described be provided.

2. Operation of the Preferred Embodiment

In operation, the present invention can be easily utilized by the common parent or care giver in conjunction with a child in a simple and effortless manner. To use the present invention with its preferred embodiment can best be described in conjunction with the perspective view of FIG. 1, the front view of FIG. 2, the rear view of FIG. 3, the electrical block diagram of FIG. 4, the system diagram of FIG. 5 and the flow diagram of FIG. 6.

To use the present invention, after purchase the parent or care giver would register the child along with the associated number of the child locating and tracking apparatus 10 and corresponding transmitting module 15 with the monitoring station 110. After a test transmission, the parent or care giver would instruct the child on the usage of the child locating and tracking apparatus 10 and what actions warrant or do not warrant the activation of the child locating and tracking apparatus 10. At this point the child locating and tracking apparatus 10 is ready to enter the monitoring and usage state.

During the daily activities of the child, the child locating and tracking apparatus 10 would be with the child at all times. In the event of danger, such as if the child should become lost or abducted, the child would simply depress the activating switch 30 on the transmitting module 15 to activate it. This action would thereby cause the first radio frequency signal 85 to be emitted to a local ground station 90 or a low earth orbit satellite 95 which would result in a land-based communication path 115 being established to a monitoring station 110 bearing the identification number of the respective transmitting module 15 and therefore the respective child. Personnel or equipment at the monitoring station 110 would follow the procedure outlined in FIG. 6. to verify that the signal received is a legitimate alarm signal. At this point the personnel or equipment at the monitoring station 110 would begin to assist the appropriate law enforcement personnel to locate the child in danger and render the appropriate assistance.

The battery 65 of the child locating and tracking apparatus 10 needs to be checked daily to verify the appropriate power level of the said battery 65. If the battery level indication light 40 is illuminated, the battery 65 should be replaced immediately, as less than 24 hours of useful running time exists. The battery 65 is replaced by removing the battery cover 35 and replacing the battery 65 in a similar manner to other small electronic products such as found with cameras, calculators and the like. This process repeats daily in a looping pattern as defined above until the child is old enough to care for him or herself.

While the aforementioned description is envisioned as being utilized with children, it should be understood that it is well within the scope of the present invention that it may be used by any person of any age with or without impediments such as mental disabilities, physical disabilities, old age, and the like.

The foregoing description is included to illustrate the operation of the preferred embodiment and is not meant to limit the scope of the invention. The scope of the invention is to be limited only by the following claims.

| COMPONENT LIST | |
|---|---|
| 10 | child locating and tracking apparatus |
| 15 | transmitting module |
| 20 | adornment |
| 25 | retaining means |
| 30 | activating switch |
| 35 | battery cover |
| 40 | battery level indication light |
| 45 | time delay activation module |
| 50 | radio frequency transmitter |
| 55 | antenna |
| 60 | time delay module |
| 65 | battery |
| 70 | voltage regulator module |
| 75 | identification module |
| 80 | digital signal path |
| 85 | first radio frequency signal |
| 90 | local ground station |
| 95 | low earth orbit satellite |
| 100 | distant ground station |
| 105 | second radio frequency signal |
| 110 | monitoring station |
| 115 | land based communication path |
| 120 | first operational block |
| 125 | first functional block |
| 130 | second functional block |
| 135 | second operational block |
| 140 | third functional block |

-continued

| COMPONENT LIST | |
|---|---|
| 145 | third operational block |
| 150 | fourth operational block |

What is claimed is:

1. A child locating and tracking apparatus comprising:

a transmitting module having a battery cover provided to allow for the replacement of an internal battery;

a battery level indication light located on the perimeter of the transmitting module, wherein said battery level indication light illuminates when less than a day's usable energy remains in the internal battery;

a time delay activation module located on the perimeter of the transmitting module, said time delay activation module to allow activation of the transmitting module should the transmitting module be removed from the child; and an internal time delay circuit to avert false alarms should the transmitting module be removed on purpose by the child, parent or care giver;

an adornment for retaining and disguising said transmitting module;

retaining means for attaching said adornment to said transmitting module, said retaining means further capable of holding said adornment with the associated transmitting module in close contact with a child's body to prevent inadvertent operation; and an activating switch for activating said transmitting module, said switch penetrating said adornment such that it may be concealed and actuated from within fabric of clothing jackets, shoes or the like;

a radio frequency transmitter for providing an output signal to an antenna; an antenna embedded in the perimeter of the transmitting module;

an activating switch for providing an input to the radio frequency transmitter through the form of a normally open push-button switch; the time delay activation module providing an input to a time delay module through the form of a normally closed push-button switch;

a voltage regulator module such that there is at least 24 hours of advance warning that the battery is depleted of power before the battery ceases to function, said output power from the voltage regulator module applied to the radio frequency transmitter and to an identification module; and an identification module individually unique for every child locating and tracking apparatus and possessing a unique digital binary signature, such that said signature is applied to the radio frequency transmitter through a digital signal path.

2. The child locating and tracking apparatus of claim 1, wherein a first radio frequency signal is emitted and travels to a local ground station that receives said first radio frequency signal and relays it to a distant ground station via a second radio frequency signal, the signals as received at either the local ground station or the distant ground station would then be forwarded to a monitoring station via a land-based communication path; and wherein a child in danger who activated the transmitting module may be found in a quick manner.

* * * * *